US005215845A

United States Patent [19]

Yusa et al.

[11] Patent Number: 5,215,845

[45] Date of Patent: Jun. 1, 1993

[54] IMAGE FORMING METHOD AND IMAGE FORMING APPARATUS

[75] Inventors: Hiroshi Yusa; Kohichi Tomiyama, both of Kanagawa; Masayoshi Kato, Saitama; Tsutomu Kukimoto; Kiyoko Tsuchiya, both of Kanagawa, all of Japan

[73] Assignee: Canon Kabushiki Kaisha, Tokyo, Japan

[21] Appl. No.: 779,808

[22] Filed: Oct. 21, 1991

[30] Foreign Application Priority Data

Oct. 26, 1990 [JP] Japan ..... 2-287160

[51] Int. Cl.[5] ..... G03G 15/08

[52] U.S. Cl. ..... 430/106.6; 355/251; 430/122

[58] Field of Search ..... 430/122, 106.6; 118/657, 658; 355/251, 252

[56] References Cited

U.S. PATENT DOCUMENTS

| | | | |
|---|---|---|---|
| 4,702,986 | 10/1987 | Imai et al. | 430/120 |
| 4,978,597 | 12/1990 | Nakahara et al. | 430/122 |
| 4,989,044 | 1/1991 | Nishimura et al. | 355/251 |
| 4,999,272 | 3/1991 | Tanikawa et al. | 430/106.6 |

*Primary Examiner*—John Goodrow

*Attorney, Agent, or Firm*—Fitzpatrick, Cella, Harper & Scinto

[57] ABSTRACT

An electrostatic image supporting member which supports an electrostatic image and a toner carrying member for conveying a magnetic toner are disposed in a development section with a specified gap therebetween. The toner carrying member has a base whose surface has an average surface roughness (Ra) of 1.0 to 3.0 μm. A resin coating containing electrically conductive fine particles is formed on the base surface at a density of 4 to 12 g per 1 $m^2$. The outer layer of the coating has an Ra from 0.8 to 3.0 μm. The toner carrying member carries an electrically insulating magnetic toner containing at least a binder resin and a magnetic component, and satisfying the conditions of a volumetric average particle size of 4.5 to 8 μm, a BET specific surface area of 1.8 to 3.5 $m^2/g$, a charge amount of −20 to −35 μc/g, a loose-state apparent density of 0.40 to 0.52 $g/cm^3$, and a true specific gravity of 1.45 to 1.8. The magnetic toner is formed into a layer having a thickness smaller than the dimension of the gap by a member for regulating the thickness by pressing the toner against the toner carrying member. The magnetic toner is then conveyed to the development section, in which the toner develops the electrostatic image while an AC electric field is applied.

30 Claims, 4 Drawing Sheets

IMAGE FORMING METHOD AND IMAGE FORMING APPARATUS

BACKGROUND OF THE INVENTION

1. Field of the Invention

The present invention relates to an image forming method, such as an electrophotographic method, an electrostatic printing method or an electrostatic recording method, in which an electrostatic latent image is developed with a magnetic toner. More particularly, the present invention relates to an electrophotographic image forming method, as well as an apparatus for carrying out the method, that is adapted to develop by reversal development a digital latent image expressed by unit pixels which are, in turn, expressed by either an on-off binary representation or a limited number of gradations.

2. Related Art

One type of conventional development apparatus is adapted to develop a latent image formed on the surface of a photosensitive drum (serving as the latent image supporting member) with a magnetic toner of a monocomponent developer. In a typical example of such an apparatus, magnetic toner particles are brought into frictional contact with a sleeve (serving as the developer conveying member), thereby triboelectrically charging the magnetic toner particles to a polarity opposite to that of the charge of the electrostatic image formed on the photosensitive drum. The magnetic toner is very thinly spread on the sleeve, and conveyed to the development region defined by the sleeve and a part of the photosensitive drum. In the development region, while a magnetic field generated by a magnet fixed in position within the sleeve is applied, the magnetic toner is caused to jump onto the photosensitive drum so as to develop the electrostatic latent image on the drum.

In such a development apparatus, it is necessary that a relatively thin, uniform magnetic toner layer be formed on the sleeve. However, such layer formation is readily influenced by environmental conditions, the physical properties of the toner, the condition of the surface of the sleeve, and the like. It is, therefore, difficult to obtain a uniform toner layer. A low-humidity environment, in particular, often results in a non-uniform layer formation.

Other problems arise from the repeated use of the magnetic developer. Since the developer is brought into frictional contact with the sleeve each time an operation cycle (such as a copying cycle) takes place, there is a risk of part of the additive(s) for improving the fluidity of the toner being deposited on the sleeve, or part of the binder resin contained in the developer being formed into a film on the sleeve. As a result, the surface properties of the sleeve may change, the developing ability of the developer may become unstable, or the conveyance of the developer to the electrostatic latent image surface may become unsatisfactory.

In order to assure high quality of copied images, various efforts have recently been made to reduce the size of toner particles in the toner layer. For example, the use of a particle size of from 4.5 to 8 μm makes it relatively easy to assure increases in the resolution and sharpness as well as the faithful reproduction of an electrostatic latent image, so that the printing density of an electrophotographic laser beam printer is increased from the conventional level of about 300 dpi to the level of about 600 dpi. Toners having such a small particle size, however, have the following disadvantages when compared with conventional toners: the amount of charge per unit volume increases and, in addition, the amount of the fine particles having a particle size of 5 μm or less increases. Accordingly, a toner with such a small particle size has an increased area for contact with the development sleeve, thereby causing the surface of the development sleeve to be easily contaminated, which raises the risk of a ghost image being formed or the image density being lowered.

Other disadvantages of toner having such a small particle size arise from the fact that the toner has a larger surface area than a more conventional toner, and that the proportion of the magnetic component is increased in order to prevent scattering of the toner. Since the magnetic component contacts the surface of the sleeve more often than usual, if the sleeve has a coated surface, the coating of the sleeve is easily scratched. Further, a relatively large amount of fine particles contained in the toner having a small particle size is, due to the mirror image force of the fine particles themselves, strongly electrostatically confined by the sleeve. Thus, fine particles tend to deposit on the sleeve in the lowermost layer of the toner, thereby preventing the other portion of the toner from being sufficiently charged by friction with the sleeve, thereby lowering the developability of the developer. Since this phenomenon is conspicuous in the non-consumed portions of the toner, the portion of the developer containing such toner portion exhibits a different level of developability from that of a developer portion where much of the toner has been consumed. Thus, such a phenomenon results in a sleeve ghost being formed on the developed image.

In order to prevent the above-described phenomenon, and to stably form a layer of uniformly charged toner, it is necessary to use a contact regulating member, such as an elastic rubber blade, disposed in contact with the sleeve, so as to prevent deposition of a fine particle layer.

There have recently been demands for increased printing speed. However, higher printing speed has increased the risk of damaging the coated surface of the sleeve. That is, the risk that the coating may be easily deteriorated, peeled, or scratched is enhanced.

SUMMARY OF THE INVENTION

An object of the present invention is to provide an image forming method and an image forming apparatus adapted to perform development of the above-described type for a long period of time and capable of ensuring that the magnetic toner is uniformly spread on the toner carrying member and that the contamination of the surface of the toner carrying member with a magnetic toner or component(s) thereof is prevented or reduced.

Another object of the present invention is to provide an image forming method and an image forming apparatus that, for long periods of time, is capable of assuring that high-quality images having high image densities, with excellent fine-line reproduction, and being clear and free of fog are obtained.

A further object of the present invention is to provide an image forming method and an image forming apparatus whose level of performance is not changed by variations in the environmental conditions.

In order to achieve the above objects, according to the present invention, there is provided an image forming method, comprising: (a) disposing an electrostatic image supporting member supporting an electrostatic image thereon and a toner carrying member for conveying a magnetic toner on the surface thereof in a development section with a predetermined gap between the members, wherein (i) the toner carrying member includes a base whose surface has irregularities with an average surface roughness (Ra) of 1.0 to 3.0 μm, and a resin coating on the surface of the base having a density of 4 to 12 g per 1 $m^2$, the resin coating containing electrically conductive fine particles and an outer layer of the resin coating having an Ra from 0.8 to 3.0 μm; and (ii) the magnetic toner is an electrically insulating magnetic toner containing at least a binder resin and a magnetic component, the magnetic toner satisfying the conditions of a volumetric average particle size of 4.5 to 8 μm, a BET specific surface area of 1.8 to 3.5 $m^2/g$, a charge amount of −20 to −35 μc/g, a loose-state apparent density of 0.40 to 0.52 $g/cm^3$, and a true specific gravity of 1.45 to 1.8; (b) conveying the magnetic toner as a layer on the toner carrying member to the development section while regulating the thickness of the magnetic toner layer to a value smaller than the dimension of the gap by employing a toner layer thickness regulating member, wherein the toner layer thickness regulating member regulates the thickness of the layer of the magnetic toner by pressing the magnetic toner against the toner carrying member; and (c) developing the electrostatic image with the magnetic toner in the development section while applying an AC electric field.

In order to achieve the above objects, according to the present invention, there is also provided an image forming apparatus, comprising: (a) an electrostatic image supporting member supporting an electrostatic image thereon; (b) a toner carrying member for conveying a magnetic toner on the surface thereof, the toner carrying member including a base whose surface has irregularities with an average surface roughness (Ra) of 1.0 to 3.0 μm, and a resin coating containing electrically conductive fine particles being formed on the surface of the base having a density of 4 to 12 g per 1 $m^2$, an outer layer of the resin coating having an Ra within the range from 0.8 to 3.0 μm, the electrostatic image supporting member and the toner carrying member being disposed in a development section with a predetermined gap between the members; (c) a container for accommodating the magnetic toner, the magnetic toner being an electrically insulating magnetic toner containing at least a binder resin and a magnetic component, the magnetic toner satisfying the conditions of a volumetric average particle size of 4.5 to 8 μm, a BET specific surface area of 1.8 to 3.5 $m^2/g$, a charge amount of −20 to −35 μc/g, a loose-state apparent density of 0.40 to 0.52 $g/cm^3$, and a true specific gravity of 1.45 to 1.8; (d) a toner layer thickness regulating member for causing the magnetic toner to be conveyed on the toner carrying member while the magnetic toner forms a layer having a thickness of a dimension smaller than the dimension of the gap, the toner layer thickness regulating member regulating the thickness of the layer of the magnetic toner by pressing the magnetic toner against the toner carrying member; and (e) a bias application means for forming an AC electric field in the development section.

DETAILED DESCRIPTION OF THE PREFERRED EMBODIMENTS

Figure 1:
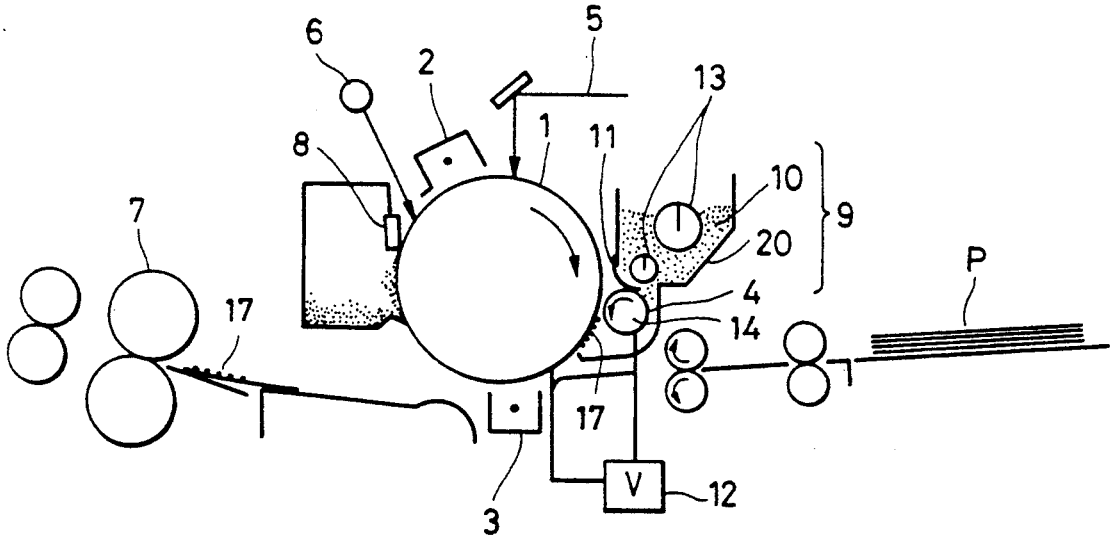
FIG. 1 schematically illustrates a specific example of an image forming apparatus according to the present invention.

According to the present invention, a toner carrying member (development sleeve) includes a base whose surface has irregularities with an average surface roughness (Ra) of 1.0 to 3.0 μm, and a resin coating containing electrically conductive fine particles which is coated on the surface of the base at a density of 4 to 12 g per 1 $m^2$. The outer layer of the coating has an Ra within the range from 0.8 to 3.0 μm. With this arrangement, toner components do not readily adhere to the surface of the toner carrying member, thereby making it possible to assure for a long period of time that contamination of the surface is prevented or reduced. Further, according to the present invention, a toner layer thickness regulating member contacts the toner carrying member. Using this arrangement, a fine toner particle layer is not formed as a lowermost toner layer on the sleeve. In addition, the regulating member causes a sufficient amount of toner to be conveyed on the surface of the sleeve, and causes a thin and uniform toner layer to be stably formed. Accordingly, it is now possible to stably obtain an adequate amount of charge of the toner, thereby assuring for a long period of time that high-density images, which are clear and free of fog, are obtained.

The above-described combination is particularly advantageous in that it provides excellent environmental stability. Thus, the above-described stable image characteristics are exhibited over a wide range of environmental conditions.

According to the present invention, a magnetic toner having values falling within the following ranges is used as the toner: a volumetric average particle size of 4.5 to 8 μm, a BET specific surface area of 1.8 to 3.5 $m^2/g$, a charge amount of −20 to −35 μc/g, a loose-state apparent density of 0.40 to 0.52 $g/cm^3$, and a true specific gravity of 1.45 to 1.8. The use of the magnetic toner provides excellent fine-line reproduction, and prevents toner scattering at the contour portion of an image, thereby making it possible to assure for a long period of time that very clear, high-quality images are obtained.

The sleeve according to the present invention is produced by preparing a cylindrical base formed of a material such as non-magnetic stainless steel or aluminum, forming irregularities with an average surface roughness (Ra) of 1.0 to 3.0 μm on the peripheral surface of the base by a suitable method (preferably a sandblasting method), and coating a coating material containing electrically conductive particles on the base surface by spraying or the like at a coating density of 4 to 12 g per 1 $m^2$, thereby forming a coating layer whose outer layer has an Ra of 0.8 to 3.0 μm. One of the reasons why the irregularities with an Ra of 1.0 to 3.0 μm are formed on the surface of the base is to improve the adhesion of the surface to the resin coating so as to prevent deterioration, such as the peeling of the coating. Since the irregularities on the surface of the base greatly influence the roughness of the surface obtained after the formation of the resin coating, the post-coating surface roughness can be adjusted relatively easily. Previously, such adjustment has been difficult. The surface of the base has an Ra of 1.0 to 3.0 μm with a view to facilitating the adjustment, i.e., the achievement of an Ra of 0.8 to 3.0 μm after the coating.

It is one of the important features of the present invention that the Ra of the coating layer is within the range from 0.8 to 3.0 μm. If the Ra is outside this range, the amount of the toner being conveyed is not an adequate amount, thereby often resulting in the occurrence of fog or ghosts.

The coating layer preferably has a resistance of $10^{-2}$ to $10^2$ Ω·cm. If the resistance of the coating layer is less than $10^{-2}$ Ω·cm, the speed at which the charge on the toner leaks is too high to prevent fogging or scattering. If the resistance is more than $10^2$ Ω·cm, the speed at which the charge leaks is too low, thereby causing the toner to be too highly charged to be readily separated from the development sleeve. This may also result in a reduction in the image density or in the occurrence of ghosts. The resistance of the coating is evaluated by forming a coating on an aluminum foil, and measuring the resistance of the coating by using a resistance meter ("Rollester", produced by Mitsubishi Yuka K. K.) and, employing a four-probe method.

In the four-probe method, two probes are applied to the coating on the aluminum foil and a voltage is applied to the two probes. Then, another two probes are applied to the coating between the two probes already located in the coating. The potential difference between the other two probes is measured, and the resistance of the coating is determined based on the measurement.

The resin component of the coating layer may be, for example, a phenol resin, an epoxy resin, a melamine resin, a polyamide resin, a silicone resin, a polytetrafluoroethylene resin, a polyvinyl chloride resin, a polycarbonate resin, a polystyrene resin, and a polymethacrylate resin. A phenol resin is most preferable.

This is for the following reasons: (1) It is relatively difficult for toner components to adhere to a phenol resin, and a phenol resin occupies a position in the triboelectric charge series that is adequately separated from the position of the toner. Accordingly, a phenol resin has an adequate chargeability, which prevents the toner from being either too highly or insufficiently charged. (2) A phenol resin is a thermosetting resin, and is known to have a relatively high degree of hardness. That is because a phenol resin forms, through a thermosetting reaction, a dense three-dimensional bridge structure. Thus, a phenol resin forms a very hard coating, thereby making it possible to achieve excellent durability, which is improved beyond the durability of the other types of resins. Accordingly, when a phenol resin is used to form a coating on the sleeve base, the coating will be free from scratches or peeling, thereby making it possible to stably provide the desired image quality. There are two categories of phenol resins, that is, a genuine phenol resin produced from phenol and formaldehyde, and a modified phenol resin which is a combination of a genuine phenol-based resin and an ester gum. A phenol resin in either category is usable in the present invention.

The coating on the base of the development sleeve according to the present invention contains electrically conductive fine particles. Materials which can be used as the electrically conductive fine particles are graphite, electrically conductive carbon, and various metal oxides. According to the results of certain tests conducted by the present inventors, those particles which form adequate irregularities on the surface of the sleeve, and which allow the charge remaining on the sleeve coating to adequately leak to the sleeve base to prevent formation of an unduly high charge on the toner, provide good results. Among such particles, electrically conductive particles in which graphite and electrically conductive carbon were used exhibited excellent properties. Graphite is a gray or black crystalline mineral having a gloss and smoothness. Either natural or artificial graphite may be used. A preferable range of the grain size of graphite is from 0.5 to 10 μm to enhance both dispersion into the resin and properties of the coating. Examples of electrically conductive carbon are oil furnace, acetylene black, and Ketjenblack (Arma Corp.). Electrically conductive carbon having a resistance of not more than 0.5 Ω·cm when a pressure of 120 kg/$cm^2$ is applied is preferable.

The coating on the base of the sleeve according to the present invention may contain, in addition to electrically conductive fine particles, other additives such as a substance capable of acting as a surface roughness material for adjusting the roughness of the coating surface, and a charge control agent for controlling the amount of charge of the toner.

If graphite and electrically conductive carbon are used, they are preferably used at a mixing ratio by weight of 1:50 to 100:1, and more preferably 1:10 to 100:1. The proportion between such mixed substance(s) and the resin is preferably within the range from $\frac{1}{3}$ to 2/1. The proportion is more preferably within the range from $\frac{1}{3}$ to 1/1, in which case the coating has excellent durability. The amount by weight of the coating applied is preferably 4 to 12 g per 1 $m^2$. If the application density is outside this range, the durability of the coating may be greatly deteriorated.

If graphite and electrically conductive carbon are used at a mixing ratio within the above-specified range, if the proportion between these mixed substances and the resin is within the above-specified range, and, simultaneously, if the application density is within the above-specified range, it is possible to form a coating which is seldom contaminated with toner components and which has a high level of durability. Thus, it is possible to obtain a toner layer (i) which remains stable, and (ii) which provides, for a long period of time, high image-density and high image-quality quality which are stably maintained.

The toner layer thickness regulating member used in the present invention comprises a member which acts to press the magnetic toner against the surface of the development sleeve. This action of the regulating member serves to prevent the formation of a fine toner particle layer as the lowermost toner layer on the sleeve. The action also serves to form a magnetic toner layer having a predetermined thickness. The toner layer thickness regulating member preferably comprises an elastic blade.

The elastic blade is composed of an elastic plate formed of: a rubber elastic material, such as urethane rubber, silicone rubber or acrylonitrile-butadiene rubber (NBR); a metal elastic material, such as phosphor bronze or sheet stainless steel; or a resin elastic material, such as polyethylene terephthalate or high-density polyethylene.

An elastic material such as silicone rubber or NBR is preferable. Preferably, the elastic blade contacting the development sleeve is curved either in the opposite (counter) direction with respect to the direction in which the development sleeve rotates or in the forward direction, so that the magnetic toner is pressed against the surface of the sleeve with an adequate force of elasticity.

Preferably, the elastic blade is disposed in contact with the development sleeve at a linear load of 5 to 80 g/cm while curved in the counter direction with respect to the direction of rotation of the development sleeve.

Figure 2:
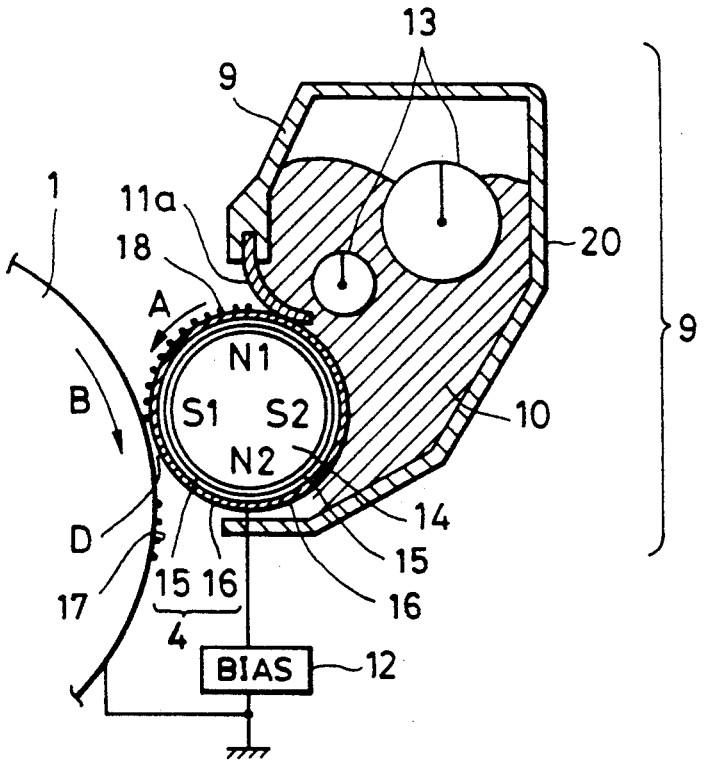
FIG. 2 is an enlarged view of a development section of the apparatus shown in FIG. 1, and schematically illustrates a development device having an elastic blade (a regulating member) directed in the opposite (counter) direction with respect to the direction in which the development sleeve rotates.
Figure 3:
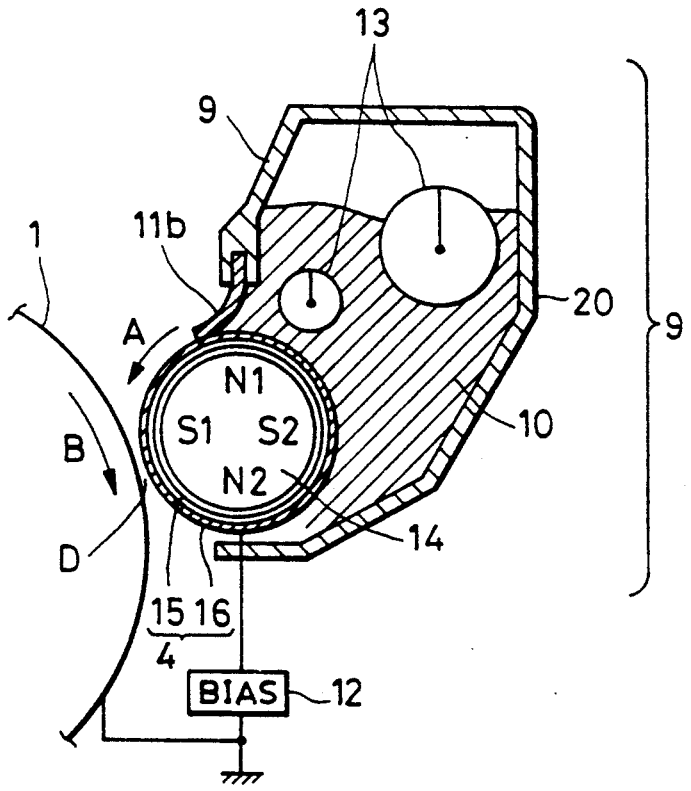
FIG. 3 is a view similar to FIG. 2, and schematically illustrates a development device having an elastic blade directed in the same direction as the direction of rotation of the development sleeve.

FIGS. 1, 2 and 3 show different examples of an image forming apparatus having the above-described features. Each apparatus is capable of stably forming, in face of variations in the environmental conditions, a thin and dense magnetic toner layer. Although the reason for this effect is not entirely clear, it is believed that the regulating member contacting the development sleeve forces toner particles into friction with the surface of the development sleeve and thus causes them to be triboelectrically charged. Accordingly, toner charging is effected in basically the same way regardless of the changes in the behavior of magnetic toner particles caused by any variations in the environmental conditions.

An image forming method and an image forming apparatus according to the present invention will be described with reference to FIGS. 1 to 3.

A part of the surface of a photosensitive drum 1 (serving as the electrostatic image supporting member) is negatively charged by a primary charging device 2. Then, an image scanning is performed by exposure to a laser beam 5, thereby forming a digital latent image on the part of the drum surface. A development device 9, which has a toner layer thickness regulating member 11, a development sleeve 4 having a magnet 14 disposed therein, and a toner container 20 containing a monocomponent magnetic toner 10, develops the latent image with the toner 10. As shown in FIGS. 2 and 3, the development sleeve 4 also has a base 15 whose surface is covered with a resin coating 16 containing electrically conductive fine particles.

The photosensitive drum 1 has an electrically conductive base (not shown). In a development section formed in the vicinity of the point at which the photosensitive member 1 is closest to the development sleeve 4, a bias applying means 12 applies either an AC electric field or a combination of an AC electric field and a DC bias to the space between the electrically conductive base of the drum 1 and the development sleeve 4. When the developed image 17 is conveyed to a transfer section where transfer paper P is fed, a transfer charging device 3 effects positive charging from the reverse surface of the transfer paper P (the surface facing away from the photosensitive drum 1), thereby electrostatically transferring the negatively-charged magnetic toner image from the surface of the drum 1 to the transfer paper P. When the transfer paper P is separated from the photosensitive drum 1, the paper P is conveyed to a heating and pressing roller fixing device 7, whereby the magnetic toner image 17 on the transfer paper P is fixed.

That part of the monocomponent developer 10 remaining on the photosensitive drum 1 after the transfer process is removed by a cleaning device 8 having a cleaning blade. After the cleaning, the part of the photosensitive drum 1 is discharged by an erase exposure device 6. Thereafter, a cycle starting with the charging process carried out by the primary charging device 2 is repeated, when necessary.

The photosensitive drum 1 serving as the electrostatic image supporting member has a photosensitive layer and an electrically conductive base (not shown), and rotates in the direction indicated by the arrow in FIG. 1 (arrows B in FIGS. 2 and 3). The development sleeve 4 (serving as the developer carrying member) has base 15 in the form of a non-magnetic cylinder, and rotates in such a manner that a part of the surface of the sleeve 4 in the development section advances in the same direction as the corresponding part of the surface of the electrostatic image supporting member. The magnet 14 as shown in FIGS. 2 and 3 comprises a multipolar permanent magnet (magnet roll) which serves as the magnetic field generating means and which is disposed in the non-magnetic cylinder of the sleeve 4. A part of the magnetic toner 10 in the container 20 is thinly spread as a layer 18 on the surface of the development sleeve 4 by the toner layer thickness regulating member 11, and is frictionally contacted with the member 11 and the surface of the sleeve so that the magnetic toner particles are charged.

In the development section, an AC field or the like is applied to the space D between the development sleeve 4 and the surface of the drum 1 on which the electrostatic image is supported. At this time, the AC bias preferably has a frequency "f" of 200 to 4000 Hz (more preferably 500 to 2000 Hz), and a peak-to-peak voltage $V_{pp}$, of 500 to 3000 V (more preferably 800 to 2600 V).

The movement of the magnetic toner particles in the development section is such that the static electricity of the surface supporting the electrostatic image and the AC bias cause the toner particles to move to the side of the electrostatic image. The toner container 20 preferably has a toner stirring means 13. This arrangement allows the magnetic toner 10 in the container 20 to be positively fed to the vicinity of the development sleeve 4, and is thus effective for assuring that a uniform magnetic toner layer 18 is formed until substantially all of the toner in the container 10 is used.

The magnetic toner used in the present invention is an electrically insulating monocomponent magnetic toner containing at least a binder resin and a magnetic component, and has the following values: a volumetric average particle size of 4.5 to 8 μm, a BET specific surface area of 1.8 to 3.5 $m^2/g$, a charge amount of −20 to −35 μc/g, a loose-state apparent density of 0.40 to 0.52 $g/cm^3$, and a true specific gravity of 1.45 to 1.8.

If the volumetric average particle size is less than 4.5 μm, the amount of fine toner particles greatly increases. This increase makes it difficult to control the charge of the magnetic toner, and also makes it impossible to obtain a stable amount of charge, thereby risking several problems. If the volumetric average particle size exceeds 8 μm, it is difficult to obtain a high level of resolution, and scattering tends to occur at the contour portion of an image.

If the amount of charge is less than −20 μc/g, it is impossible to obtain a sufficient charge amount on the sleeve, thereby often causing a reduction in the image density. If the charge amount exceeds $-35\ \mu c/g$, there is a risk of a reduction in the image density due to excessive charging, or the risk of ghost images.

If the BET specific surface area is less than 1.8 $m^2/g$, an excessively long time is required in order to provide a sufficient amount of charge on the sleeve, thereby involving the risk of a reduction of image density in the initial stages of the operation. Such a reduction may result in the production of images suffering from substantial fog. If the BET specific surface area exceeds 3.5 $m^2/g$, a significant mirror image force effect takes place involving the sleeve, thereby causing a reduction in the development ratio. Such a reduction often results in a reduction in the image density.

If the true specific gravity is less than 1.45 $g/cm^3$ in a system where development is performed by applying an AC bias in a magnetic field, fog tends to occur. Also, the line width is unnecessarily increased, which results in a low level of resolution. If the true specific gravity is more than 1.8 $g/cm^3$, lines may be discontinuous and the image density may be reduced. For these reasons, the magnetic toner according to the present invention has a true specific gravity of 1.45 to 1.8 $g/cm^3$.

The magnetic toner according to the present invention has a loose-state apparent density of 0.4 to 0.52 $g/cm^3$ (preferably 0.45 to 0.5 $g/cm^3$). Thus, one of the features of the magnetic toner is that the loose-state apparent density is small when compared to the true specific gravity. The porosity calculated from the true specific gravity and the loose-state apparent density is preferably from 62 to 75 %. The porosity ($\epsilon a$) is calculated by the following formula:

$$\text{Porosity} = \frac{\text{True Specific Gravity} - \text{Loose-state Apparent Density}}{\text{True Specific Gravity}} \times 100(\%)$$

The solid-state apparent density of the magnetic toner is preferably within the range from 0.8 to 1.0 and, within this range, the porosity ($\epsilon p$) is preferably from 40 to 50%.

If $\epsilon a$ is less than 62%, then the mere stirring of toner within the toner container in the development device cannot assure that toner particles will be sufficiently separated from each other. If $\epsilon a$ is more than 75%, the magnetic toner tends to be scattered or leaked.

If $\epsilon p$ is less than 40%, the developer tends to clog within the development device, thereby making it impossible for a portion of the developer to be smoothly supplied to the developer carrying member, which often causes a part of the latent image to be undeveloped. If $\epsilon p$ is more than 50%, a development device having a greater capacity is required to allow the same amount of developer to be accommodated in the container, thereby hindering the entire apparatus (such as a printer) from being made compact.

The amount of charge on the magnetic toner, which is specified as above according to the present invention, is evaluated in the following manner. One gram of the magnetic toner and 9 g of an iron powder carrier of 200 to 300 mesh are charged in a 50 cc polyethylene bottle. The bottle is closed by a cap, and vibrated by hand for 20 sec. (or about 100 times) at a temperature of 23° C. and a humidity of 60% RH. A small amount of the mixture thus stirred is received in a container of an apparatus such as that shown in FIG. 4, and suction is performed at a pressure of 250 mm $H_2O$ for about one minute until the saturation potential is reached. On the basis of the saturation potential V reached at this time, as well as on the basis of the capacity C of a capacitor, the weight $W_1$ of the container before the suction and the weight $W_2$ of the container after the suction, the charge amount Q of the magnetic toner is calculated by the following formula:

$$Q = \frac{CV}{W_1 - W_2}$$

For example, 1 g of magnetic toner powder which has been left to stand for at least 12 hours in an environment of 20° C. and relative humidity of 60% RH, and 9 g of carrier iron powder not coated with a resin having a mode particle size of 200 to 300 mesh (e.g., EFV 200/300, produced by Nippon Teppun K. K.) are thoroughly mixed together in a polyethylene pot having a volume of about 50 cc in the same environment as mentioned above (by shaking the pot in hands vertically about 100 times for about 20 sec).

Figure 4:
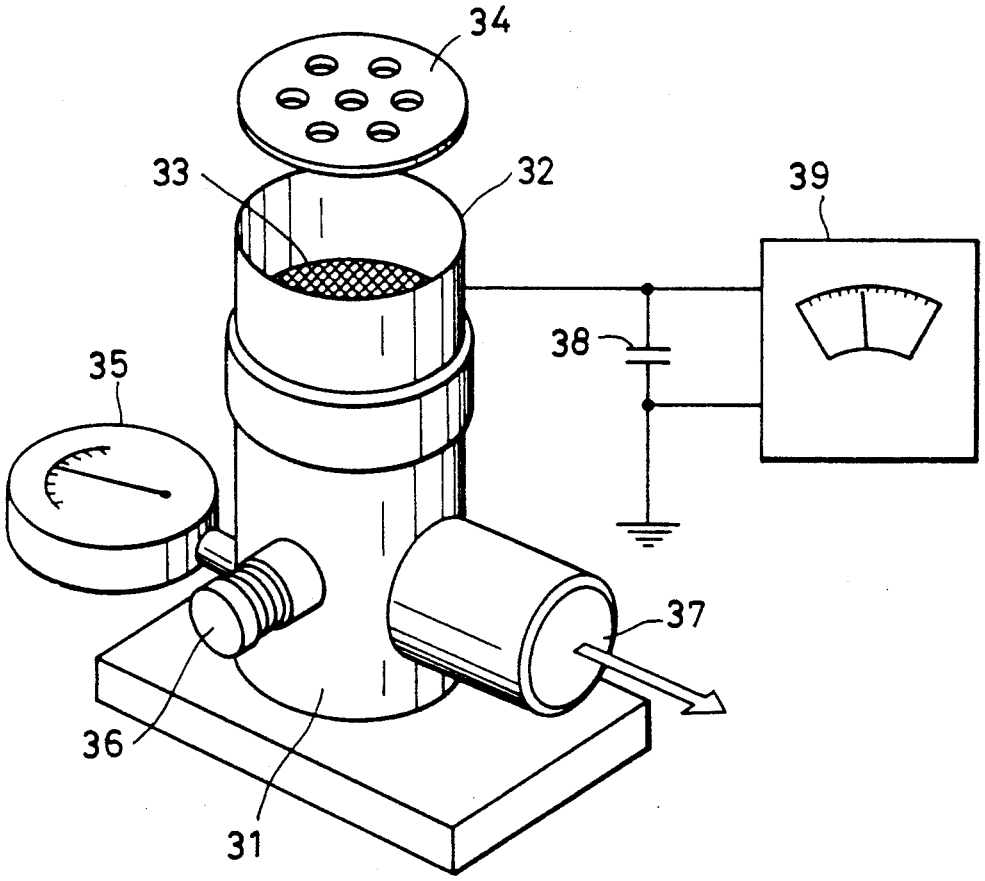
FIG. 4 schematically illustrates an apparatus for evaluating the amount of the charge of a toner, a silica fine powder, or a mixture thereof.

Then, about 0.5 g of the shaken mixture is charged in a metal container 32 for measurement provided with a 400-mesh screen 33 at the bottom as shown in FIG. 4 and covered with a metal lid 34. The total weight of the container 32 is weighed and denoted by $W_1$ (g). Then, an aspirator 31 composed of an insulating material at least with respect to a part contacting the container 32 is operated, and the magnetic toner powder in the container is removed by suction through a suction port 37 sufficiently while controlling the pressure at a vacuum gauge 35 at 250 mmHg by adjusting an aspiration control valve 36. The reading at this time of a potential meter 39 connected to the container 32 by the medium of a capacitor having a capacitance C (uF) is denoted by V (volts.). The total weight of the container after the aspiration is measured and denoted by $W_2$ (g). Then, the triboelectric charge Q (uC/g) of the magnetic toner powder is calculated as $\{C \times V/(W_1 - W_2)\}$.

The BET specific surface area of the magnetic toner is calculated by employing a specific surface area meter ("Autosorb 1", produced by QUANTACHROME) by a BET one point method.

For example, about 0.6 g of the magnetic toner is charged into a cell. The magnetic toner in the cell is degassed at a temperature of 35° C. under reduced pressure of $1.0 \times 10^{-3}$ mmHg for one hour or more. Then, the magnetic toner in the cell is cooled with liquid nitrogen and the adsorption of nitrogen gas with the magnetic toner is carried out under cooling with liquid nitrogen. The amount of nitrogen gas adsorbed with the magnetic toner is determined by BET one point method with the specific surface area meter "Autosorb 1".

The loose-state apparent density, which is specified as above according to the present invention, is evaluated by employing a Powder Tester (produced by Hosokawa Micron K. K.) and a container attached to the tester in the manner described in the instruction manual of the powder tester.

The true density, which is specified as above according to the present invention, is evaluated by adopting the following method as a method accurate and convenient for the measurement of a fine powder material.

A stainless steel cylinder having an inner diameter of 10 mm and a height of about 5 cm, a disk A having an outer diameter of about 10 mm and a height of 5 mm, and a piston B having an outer diameter of about 10 mm and a length of 8 cm are prepared, both of the disk and the piston being capable of being tightly inserted into the cylinder. The disk A is received in the cylinder at the bottom thereof, then about 1 g of a measurement sample is charged in the cylinder, and the piston is gently advanced into the cylinder. The piston is subjected to a force equivalent to 400 kg/cm$^2$ by a hydraulic press, and the sample is taken out of the cylinder after it has been compressed for five minutes. The weight W (g) of the compressed sample is measured by a scale, and the diameter D (cm) and the height L (cm) of the sample are measured by a micrometer. The true density is calculated by the following formula:

$$\text{True Density (g/cm}^3) = \frac{W}{\pi \times (D/2)^2 \times L}$$

The distribution of the particle size of the magnetic toner can be measured by various methods. According to the present invention, this measurement is performed by employing a Coulter counter.

The apparatus used in the measurement is the Coulter Counter TA-II (produced by Coulter), to which an interface (produced by Nihon Kagaku Kikai K. K.) for outputting the particle number distribution and the volumetric distribution, as well as the CX- 1 Personal Computer (produced by Canon), are connected. A 1%-NaCl aqueous solution is prepared as an electrolyte employing extra pure sodium chloride. The measurement method is as follows: 0.1 to 5 ml of a surfactant (preferably alkylbenzenesulfonate) as a dispersing agent, and 2 to 20 mg (approximately 30,000 to 300,000 particles) of a measurement sample are added to 100 to 150 ml of the electrolytic aqueous solution. The resultant electrolytic solution in which the sample is suspended is subjected to dispersion treatment by an ultrasonic dispersing device for about 1 to 3 minutes. Then, the above measurement apparatus, as well as a 100 $\mu$ aperture device, is used to measure the distribution of the particle size of particles having a size of 2 to 40 $\mu$ with the number of these particles serving as the reference. Then, the value specified according to the present invention is calculated.

Various materials for the magnetic toner according to the present invention will be described.

A magnetic material contained in the magnetic toner may be any of the following: an iron oxide such as magnetite, hematite or ferrite; a metal such as iron, cobalt or nickel; and one of alloys or mixtures of these metals and metals such as aluminum, cobalt, copper, lead, magnesium, tin, zinc, antimony, beryllium, bismuth, cadmium, calcium, manganese, selenium, titanium, tungsten and vanadium.

A ferromagnetic material, such as above, having an average particle size of 0.1 to 0.5 $\mu$m is preferable. More preferable is a ferromagnetic material having an average particle size of 0.1 to 0.3 $\mu$m.

A preferable magnetic material has the following magnetic characteristics when 10 KOe is applied: a coercive force (Hc) of 20 to 150 oersted; a saturation magnetization ($\sigma$s) of 50 to 200 emu/g; and a residual magnetization ($\sigma$r) of 2 to 20 emu/g.

The amount of a magnetic material contained in the magnetic toner is preferably 20 to 200 parts by weight relative to 100 parts by weight of a binder resin, and more preferably 40 to 150 parts by weight relative to 100 parts of a binder resin.

A binder resin used in the magnetic toner according to the present invention may be any of the examples of toner binder resins listed below when the fixing device used is a heating and pressing roller fixing device having an oil coater: a polymer of either styrene or a substitution compound of styrene, such as polystyrene, poly-p-chlorostyrene or polyvinyltoluene; a styrene-containing copolymer, such as a styrene-p-chlorostyrene copolymer, a styrene-vinyltoluene copolymer, a styrene-vinylnaphthalene copolymer, a styrene-acrylic acid ester copolymer, a styrene-methacrylic acid ester copolymer, a styrene-methyl $\alpha$-chloromethylacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, or a styrene-acrylonitrile-indene copolymer; polyvinyl chloride; a phenol resin; a naturally modified phenol resin; a natural resin modified maleic acid resin; an acrylic resin; a methacrylic resin; polyvinyl acetate; a silicone resin; a polyester resin; polyurethane; a polyamide resin; a furan resin; an epoxy resin, a xylene resin; polyvinyl butyral; a terpene resin; a coumarone-indene resin; and a petroleum resin.

When a heating and pressing roller fixing system which uses substantially no oil coating is employed, the so-called offset phenomenon can occur (i.e., the undesired transfer of part of the toner image from the toner image supporting member to the roller). This can be caused by an unduly low adhesivity of the toner image to the supporting member. Another problem which must also be taken into consideration is that a heat fixable toner, which allows an image to be fixed with the application of a small thermal energy, has the property of blocking or caking easily while being stored under normal conditions or in the development device. The most important factors influencing these phenomena are the physical properties of the binder resin contained in the toner. It has been found that, if the content of the magnetic component in the toner is reduced, then although the adhesion of the toner to the toner image supporting member is improved, the offset phenomenon readily occurs, and the blocking or caking also readily occurs. For this reason, when a heating and pressing roller fixing system (not employing an oil coating) is employed in the present invention, the selection of the binder resin is more important than in the case when an oil coating is used. In the non-oil fixing system, a preferable binder is a cross-linked styrene-containing copolymer or cross-linked polyester.

In the case of a styrene-containing copolymer, a comonomer which can be combined with a styrene monomer to form the copolymer may be any of the following: a monocarboxylic acid or a substitution compound thereof which has a double bond, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile or acrylamide; either a dicarboxylic acid or a substitution compound thereof which has a double bond, such as maleic acid, butyl maleate, methyl maleate, or dimetyl maleate; a vinyl ester, such as vinyl chloride, vinyl acetate, or vinyl benzoate; an ethylene-series olefin, such as ethylene, propylene, or butylene; a vinyl ketone, such as vinyl methyl ketone or vinyl hexyl ketone; and a vinyl ether, such as vinyl methyl ether, vinyl ethyl ether or vinyl isobutyl ether. Either single vinyl monomers or two or more vinyl monomers are combined with the styrene monomer.

A compound used as the cross linking agent is primarily a compound having at least two polymerizable double bonds, which is, for example,: an aromatic divinyl compound, such as divinylbenzene or divinylnaphthalene; a carboxylic acid ester having two double bonds, such as ethylene glycol diacrylate, ethylene glycol dimethacylate or 1,3-butanediol dimethacrylate; a divinyl compound, such as divinyl aniline, divinyl ether, divinyl sulfide or divinyl sulfone; or a compound having at least three vinyl groups. One of such cross-linking compounds or a mixture thereof may be used.

A charge control agent is preferably added to the magnetic toner according to the present invention. The charge control agent is contained in the toner particles (internal addition) or mixed with the toner particles (external addition). Preferably, the charge control agent is contained in the toner particles. If a charge control agent is added, it is possible to control the charge amount to the optimal value of the development system adopted. The use of a charge control agent in the present invention is particularly advantageous in that it is possible to further stabilize the balance between the particle size distribution and the charge amount. That is, if a charge control agent is used, it is possible to assure certain function separation and certain mutual compensation which are necessary to the achievement of high image-quality when the particle size varies within the above-described range.

A negative-charge control agent which may be used in the present invention is, for example: a metal complex or a salt of a monoazo dye; or a metal complex or a salt of salicylic acid, alkylsalicylic acid, dialkylsalicylic acid or naphthoic acid.

The above charge control agent is preferably used in the form of fine particles. In this case, the charge control agent has a particle-number average particle size which is preferably not more than 4 $\mu$m, and more preferably, not more than 3 $\mu$m.

When such a charge control agent is contained in the toner particles, the charge control agent is used in an amount which is preferably 0.1 to 10 parts by weight (more preferably 0.1 to 5 parts by weight) relative to 100 parts by weight of the binder resin.

Generally, any conventional dye or pigment which has hitherto been known as a coloring agent may be used. Normally, such a coloring agent may be used in an amount of 0.5 to 20 parts by weight relative to 100 parts by weight of the binder resin.

The magnetic toner according to the present invention may be mixed with a hdyrophobic silica powder. Since the magnetic toner according to the present invention has a greater specific surface area than a conventional toner, when particles of the magnetic toner are brought into contact with the cylindrical, electrically conductive surface of the sleeve having a magnetic field generating means therein so that the particles will be triboelectrically charged, the toner has a larger contact area compared to that of a conventional magnetic toner. This involves a higher risk of the abrasion of toner particles, and the contamination of the sleeve surface. If the magnetic toner according to the present invention is combined with a silica fine powder, the existence of the silica fine powder between the magnetic toner particles and the sleeve surface makes it possible to greatly reduce the risk of abrasion. Accordingly, it is possible to render the life of the magnetic toner and the sleeve longer, and to maintain stable charging ability. Thus, it is possible to assure that high-quality images are stably provided even for a long period of service.

The silica fine powder may be either a silica fine powder produced by a dry process or a silica fine powder produced by a wet process. A dry-process silica fine powder is preferably be used from the viewpoint of anti-filming ability and durability.

The dry process mentioned here is a process in which a silica fine powder is generated from the vapor-phase oxidation of a silicon halide. Such a process is, for example, a process utilizing the thermal decomposition oxidation reaction of a silicon tetrachloride gas in the presence of oxygen and hydrogen, and the process is based on the reaction expressed by the following formula:

$$SiCl_4+2H_2+O_2 \rightarrow SiO_2+4HCl$$

In such a production process, if another metal halide, such as aluminum chloride or titanium chloride, is used together with silicon halide, it is possible to obtain a composite fine powder material of silica and another metal oxide. Such a fine powder is one form of the silica fine powder according to the present invention.

A silica fine powder which may be used in the present invention, and which is generated from the vapor-phase oxidation of a silicon halide is available from the market. Examples of such silica fine powders are sold on the market under the following trade names:

| | |
|---|---|
| AEROSIL | 130 |
| (Japan Aerosil K. K.) | 200 |
| | 300 |
| | 380 |
| | OX50 |
| | TT600 |
| | MOX80 |
| | MOX170 |
| | COK84 |
| Ca-O-Sil | M-5 |
| (CABOT CO.) | MS-7 |
| | MS-75 |
| | HS-5 |
| | EH-5 |
| Wacker HDK N 20 | V15 |
| (WACKER-CHEMIE GmbH) | N20E |
| | T30 |
| | T40 |
| D-C Fine Silica | |
| (Dow-Corning Co.) | |
| Fransol | |
| (Fransil Co.) | |

On the other hand, when a wet process is to be used to produce a silica fine powder of the present invention, the wet process may be one of various known processes. For instance, sodium silicate may be decomposed by an acid, as expressed by the following general reaction formula:

$$Na_2O \cdot XSiO_2+HCl+H_2O \rightarrow SiO_2 \cdot nH_2O+NaCl$$

Other usable processes include: the decomposition of sodium silicate by an ammonia salt or an alkali salt; a process in which an alkaline earth metal silicate is generated from sodium silicate, and thereafter decomposed by an acid to obtain a silicic acid; a solution of sodium silicate is treated with an ion exchange resin to obtain a silicic acid; and a process employing a natural silicic acid or silicate.

The silica fine powder being discussed here is, for example: silicic acid anhydride (silica); or a silicate such as aluminum silicate sodium silicate, potassium silicate, magnesium silicate or zinc silicate.

Among such silica fine powders, those having a specific surface area of 70 to 300 $m^2/g$ (evaluated by a BET method employing nitrogen adsorption) provide good results. If a silica fine powder is coarser than 70 $m^2/g$, no advantageous effect is provided by the addition of the powder to the magnetic developer. If the powder is finer than 300 $m^2/g$, there is a great possibility of part of the powder existing as a free substance, thereby involving the risk of the non-uniform deposition of silica or the generation of black spot(s) due to aggregates.

Preferably, 0.6 to 1.6 parts by weight of a silica fine powder is used relative to 100 parts by weight of the magnetic toner.

A preferable hydrophobic silica powder is a negatively chargeable hydrophobic silica powder.

If a hydrophobic silica powder is used in the present invention, the powder preferably has a charge amount of $-100$ to $-300$ $\mu c/g$. If the powder has a charge amount of less than $-100$ $\mu c/g$, the charge amount of the toner is decreased, and the humidity characteristic is deteriorated. If the powder has a charge amount exceeding $-300$ $\mu c/g$, this may promote sleeve memory. Further, the powder may be easily influenced by deterioration of the silica, thereby reducing the durability.

If a negatively chargeable silica fine powder is to be used, its charge amount is measured in the same manner as described above for measuring the charge amount of the toner. In the charge amount measurement for the negatively chargeable silica fine powder, however, the silica fine powder and an iron powder carrier are mixed with each other at a mixing ratio of 2:98.

In the production of a silica fine powder to be used in the present invention, it is possible to use either a dry-process silica (the so-called pyrogenic or fumed silica) generated from the vapor-phase oxidation of a silicon halide or a wet-process silica produced from water glass or the like. However, a dry-process silica which has less silanol groups on the surface and in the interior, and which involves less production residue, is preferred.

In order to render a silica fine powder hydrophobic, the powder is chemically treated with an organic silicon compound or the like which is capable of reacting with or physically adsorbing on the silica powder. In a preferable method of this treatment, a dry-process silica powder generated from the vapor-phase oxidation of a silicon halide is treated with a silane coupling agent. Either after or simultaneously with, this treatment, the powder is treated with an organic silicone compound such as silicone oil.

The silane coupling agent used in the above treatment is, for example, hexamethyldisilazane, trimethylsilane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyldimethyl chlorosilane, $\alpha$-chloroethyl trichlorosilane, $\beta$-chloroethyl trichlorosilane, chloromethyldimethyl chlorosilane, triorganosilyl mercaptan, trimethylsilyl mercaptan, triorganosilyl acrylate, vinyldimethyl acetoxysilane, dimethyl ethoxysilane, dimethyl dimethoxysilane, diphenyl diethoxysilane, hexamethyl disiloxane, 1,3-divinyltetramethyl disiloxane, or 1,3 diphenyltetramethyl disiloxane.

The organic silicon compound is, for example, silicone oil.

A preferable silane coupling agent is hexamethyldisilazane (HMDS). A preferable silicone oil is a silicone oil having a viscosity at 25° C. of about 3'30 to 1,000 stokes ($cm^2/sec$), and is preferably, for example, dimethyl silicone oil, methylphenyl silicone oil, $\alpha$-methylstyrene-modified silicone oil, chlorophenyl silicone oil, or fluorine-modified modified silicone oil. Based on the objects of the present invention, silicone oils containing a substantial number of —OH groups, COOH groups, $—NH_2$ groups or the like are not preferable.

The treatment with a silicone oil may be performed, for example, by directly mixing the silica fine powder treated with a silane coupling agent with a silicone oil in a mixer such as a Henschel mixer, or by spraying a silicone oil onto the silica fine powder serving as the base material. Alternatively, after a silicone oil is dissolved or dispersed in a suitable solvent, the solution or dispersion may be mixed with the silica fine powder, and this mixing is followed by removing the solvent.

The degree of hydrophobic property of the silica fine powder according to the present invention is the value measured by a certain method, described below. Needless to say, other methods may be used referring to the method according to the present invention.

A 200 ml liquid-separating funnel, which can be tightly closed, is prepared. 100 ml of ion-exchanged water and 0.1 g of a sample are received in the funnel, and the contents of the funnel are agitated by a shaker (Turbular Shaker-Mixer T2C) at 90 rpm for 10 minutes to provide mixing. After the mixing, the contents are held for 10 minutes. After a silica fine powder layer and a water layer separate from each other, 20 to 30 ml of the water layer (the lower layer) is collected and placed in a 10 mm cell. A wavelength of 500 nm is used to measure the transmittance. A blank consisting of ion-exchanged water containing no silica fine powder serves as the reference. The value of the transmittance thus measured is used as the degree of hydrophobic property of the silica.

The hydrophobic silica fine powder according to the present invention preferably has a degree of hydrophobicity of at least 90% (more preferably at least 93%). If the degree of hydrophobicity is less than the 90% limit, the silica fine powder adsorbs water in a high-humidity environment, making it difficult to obtain a high-quality image under such conditions.

The magnetic toner according to the present invention may contain additive(s) other than a silica fine powder as required.

Such additives are, for example, a charge auxiliary agent, a charge imparting agent, a fluidity imparting agent, caking preventing agent, a separating agent for use with thermal roll fixing, a lubricant, and resin fine particles or inorganic fine particles which act as an abrasive.

A magnetic toner for developing an electrostatic image according to the present invention is produced in the following manner: A magnetic powder and thermoplastic resin(s) of a vinyl type and/or a non-vinyl type (and additionally additives such as a pigment or dye as a coloring agent, a charge control agent, etc. when required) are adequately mixed with each other by a mixer, such as a ball mill. Thereafter, the mixture is processed by a hot kneading machine such as a hot roll, a kneader or an extruder so as to melt, to become mixed together and/or kneaded until the components of the mixture are compatible with each other. If a pigment or dye is used, it is dispersed or dissolved in the processed mixture. After the resultant mixture is cooled and solidified, it is pulverized and strictly classified, thereby obtaining an electrically-insulating magnetic toner according to the present invention.

Further, the electrically-insulating magnetic toner having a predetermined particle size and a predetermined particle size distribution is mixed with a prescribed amount of a hydrophobic silica fine powder, thereby preparing a magnetic developer according to the present invention.

The present invention will now be specifically described with respect to examples. These examples hereby illustrate certain preferred embodiments and are not limitative of scope. In the following examples, the proportions of various components are expressed in terms of parts by weight.

EXAMPLE 1

The production of development sleeves is illustrated by the following illustrative example in which the preparation of the coating materials, preparation of sleeve bases and preparation of coated sleeves is specifically exemplified:

a. Preparation of Coating Materials:

| | Weight parts |
|---|---|
| Coating Material A | |
| Phenol Resin | 20 |
| Graphite (average particle size: 7 μm) | 9 |
| Electrically Conductive Carbon (average particle size: 0.2 μm) | 1 |
| Isopropyl Alcohol (IPA) | 20 |
| Coating Material B | |
| Phenol Resin | 20 |
| Graphite (average particle size: 10 μm) | 9 |
| Electrically Conductive Carbon (average particle size: 0.1 μm) | 1 |
| Methanol | 20 |

The components of each coating material having the above composition were dispersed for 3 hours in a paint shaker already containing glass beads. Thereafter, the solid content of each coating material was adjusted to 25%, thereby preparing coating materials A and B.

b. Preparation of Sleeve Bases:

Sleeve bases were prepared by using drawn pipes of the aluminum alloy 3003, and sandblasting the surfaces of the pipes with Alundum brand abrasive-grains (crystalline alumina). The sandblasting was performed by using a sandblaster ("Newmablaster", produced by Fuji Seisakusho K. K.) which employs a common air method.

c. Preparation of Coated Sleeves:

The above coating materials were coated by an air spray method on the surfaces of the sleeve bases (which had been subjected to the sandblasting), thereby producing coated sleeves A to F, shown in Table 1, which were to be used in the following examples.

EXAMPLE 2

In this example, a magnetic toner of the present invention was prepared as follows:

| Magnetic Toner A (Example of the Present Invention) | |
|---|---|
| Styrene-Butyl Acrylate Copolymer (copolymerization ratio = 8:2, Mw = 250,000) | 100 |
| Magnetic Component (average particle size: 0.2 μm) | 100 |
| Low-Molecular-Weight Polypropylene | 3 |
| Chromium Complex of Monoazo Dye | 0.5 |

The above components were molten and kneaded by a twin-screw extruder overheated to 130° C. The kneaded mixture was cooled, and then crushed by a hammer mill. The crushed mixture was pulverized by a jet mill, thereby obtaining a pulverized powder. The powder was classified by a fixed-wall type air classifier, thereby obtaining a classified powder. The powder was processed by a multi-stage classification apparatus ("Elbowjet Classifier", produced by Nittetsu Kogyo K. K.) utilizing the Coanda effect, whereby very small particles and coarse particles were strictly classified and removed from the powder. In this way, a black fine powder (magnetic toner) having a volumetric average particle size of 6.5 μm was obtained.

100 parts of the magnetic toner and 0.1 part of negatively chargeable hydrophobic silica (which had a triboelectrical charge amount of −235 μc/g, a BET specific surface area of about 200 $m^2/g$, and a degree of hydrophobic property of 95%, and which was rendered hydrophobic by a process employing dimethyl dichlorosilane and silicone oil) were mixed with each other by a Henschel mixer. The mixture was passed through a sieve of 100 mesh (Taylor mesh), thereby obtaining a magnetic toner A according to the present invention. The magnetic toner A had a BET specific surface area of 2.4 $m^2/g$, a charge amount of −27 82 c/g, a loose-state apparent density of 0.48 $g/cm^3$, and a true specific gravity of 1.65.

COMPARISON EXAMPLE 2

A magnetic toner B (comparison example) having a volumetric average particle size of 11.0 μm was obtained in exactly the same manner as the production of the magnetic toner A in Example 2 except that 60 parts of the magnetic material was used, and that 0.5 part of the hydrophobic silica was mixed with the magnetic toner. The magnetic toner had a BET specific surface area of 1.5 of $m^2/g$, a charge amount of −18.1 μc/g, a loose-state apparent density of 0.54 $g/cm^3$, and a true specific gravity of 1.39.

EXAMPLES 3 TO 6 AND COMPARISON EXAMPLES 3 to 5

A laser beam printer ("LBP-8AJI" produced by Canon) was modified for printing at a speed of 16 sheets (A4, vertical) per minute. Further, a development device such as that shown in Table 2 was used, and an elastic blade, serving as a toner layer thickness regulating member, was brought into pressure contact with a development sleeve at a contact pressure of 23 g/cm while directed in the direction counter to the movement of the development sleeve.

Endurance image-formation tests were performed employing the printer and a reversal development method in which a part of the surface of a photosensitive drum having a laminated-type organic photoconductor (OPC) was subjected to a primary charging at −700 V, a digital latent image was formed on the part of the surface of the photosensitive drum with a potential of −100 V at the part exposed to a laser beam, and reversal development was effected by applying a DC bias of −500 V and an AC bias of 1800 Hz and 1600 V (peak to peak). The endurance image-formation tests were performed until 10,000 processed sheets were obtained in an intermittent mode where 3 sheets were processed per minute. The tests were performed under three different environmental conditions, i.e., a normal-temperature normal-humidity (25° C., 65% RH) condition (indicated as "N/N" in Table 2), a high-temperature high-humidity (30° C., 90% RH) condition ("H/H") and a low-temperature low humidity (15° C., 10% RH) condition ("L/L"). In the tests, the various combinations of the sleeves and the magnetic toners shown in Table 2 were used.

Table 2 also shows the results of the tests of Examples 3 to 6 and Comparison Examples 3 to 5.

In the image formation tests, Examples 3 to 5 respectively employed the sleeve A whose coating had an Ra of 1.8 μm, the sleeve B whose coating had an Ra of 1.2 μm and the sleeve C whose coating (type A) had a Ra of 2.4 μm. Example 6 employed the sleeve F whose coating (type B) had an Ra of 2.0 μm and contained graphite and carbon having grain diameters different from those of the corresponding components of the coating of the other sleeves.

As shown in Table 2, all of Examples 3 to 6 provided good results with respect to the image density and the occurrence of ghost and fog (the grades and the methods used in the evaluation will described later). The Ra of the coated sleeve surface has a positive relationship with the amount of the toner layer on the sleeve, and the results of Examples 3 to 6 prove this fact. Example 4, where the coating of the sleeve had an Ra of 1.2 μm, had a relatively small amount of the toner layer, and thus, in this example, the results concerning ghost images were poorer than those in the other Examples. In contrast, Example 5, where the coating of the sleeve had an Ra of 2.4 μm, had a relatively great amount of the toner layer, and thus, in this example, the results regarding formation of fog were poorer than those in the other Examples.

Comparison Example 3 employed the sleeve D in which the coating material (type A) was coated on a non-blasted surface of the sleeve base to form a coating layer having an Ra of 0.6 μm. It will be understood from the results of this comparison example that a small amount of the toner layer causes the image density to be low from the initial stage. Also in Comparison Example 3, the non-blasted sleeve base having an Ra of 0.5 μm resulted in the sleeve coating layer being peeled. Accordingly, that peeling resulted in the respective levels of performance with respect to ghost, fog and image density being lowered as the endurance tests proceeded from the initial stage to the final stage (the processing of the 10,000th sheet).

Comparison Example 4 employed the sleeve E where the amount of the coating was 3 g per unit area. Consequently, although in this comparison example the coated sleeve surface had an Ra value of 2.0, the results concerning ghost were poor. This was perhaps because the coating layer had such an insufficient thickness that the characteristics of the coated surface of the sleeve were not much different from those of the surface of the sleeve base. The peeling of the coating occurred after the endurance tests, which peeling rendered the performance with respect to ghost even worse.

Comparison Example 5 had exactly the same arrangements as Example 3 except that the magnetic toner B was used. However, in this comparison example, since the toner had a great volumetric average grain size and a small true specific gravity, the results were not satisfactory; in particular, severe scattering occurred at the edge portions of images after the processing of the 10,000th sheet.

As described above, in the image forming method and the image forming apparatus according to the present invention, the combination of a specific toner carrying member and a specific toner layer thickness regulating member serves to provide image qualities having excellent environmental stability, while the magnetic toner used in the present invention serves to provide very clear and high-quality images for a long period of time.

The results of the tests were evaluated in accordance with the following grades and/or by the following methods.

Image Density ($D_{max}$)

The densities of five different image areas, each being an area of 5 mm square, were measured by a Macbeth reflection density meter, and the average of the densities were calculated as the image density.

Ghost

In the endurance image-formation tests, a first pattern having no image on the central portion was continuously fed to the apparatus, and a second pattern having a solid-black image was fed each time the first pattern has been fed 1000 sheets. Then, the difference in density between the central portion of the second pattern and the other portion was evaluated by eye observation. The evaluation grades were as follows:

◎. . . no difference in density
○. . . slight difference in density, though almost inconspicuous
Δ. . . conspicuous difference in density
x . . . very low density in the central portion

Fog

The fog on the reversal portion was transferred from the drum to a piece of mending tape, then evaluated by eye observation. The evaluation grades were as follows:

◎. . . no fog
○. . . slight fog observed with a magnifier, though inconspicuous
Δ. . . slightly conspicuous fog
x . . . conspicuous fog

Peeling of Coating

The peeling of the sleeve coating was evaluated by eye observation after the processing of 10,000 sheets. The following evaluation grades were used:

◎. . . no peeling
○. . . slight peeling

TABLE 1

| | Outline of Sleeves | | | | | |
|---|---|---|---|---|---|---|
| | BASE | | COATING SURFACE | | | |
| | BLAST CONDITIONS | Ra (μm) | COATING TYPE | AMOUNT ($g/m^2$) | Ra (μm) | RESISTANCE (Ω · cm) |
| SLEEVE A | A#100 AIR PRESSURE 2 $kg/cm^2$ | 2.0 | A | 8.0 | 1.8 | 6 |
| SLEEVE B | A#220 AIR PRESSURE 2 $kg/cm^2$ | 1.0 | A | 8.0 | 1.2 | 6 |
| SLEEVE C | A#100 AIR PRESSURE 4 $kg/cm^2$ | 3.0 | A | 8.0 | 2.4 | 6 |
| SLEEVE D (COMPARISON EXAMPLE) | NO BLASTING | 0.5 | A | 8.0 | 0.6 | 6 |
| SLEEVE E (COMPARISON EXAMPLE) | A#100 AIR PRESSURE 2 $kg/cm^2$ | 2.0 | A | 3.0 | 2.0 | 6 |
| SLEEVE F | A#100 AIR PRESSURE 2 $kg/cm^2$ | 2.0 | B | 8.0 | 2.0 | 5 × 10 |

TABLE 2

| | DEVELOPMENT SLEEVE | MAGNETIC TONER | ENVIRONMENT | (N/N) INITIAL STAGE | (N/N) FINAL STAGE | (L/L) INITIAL STAGE | (L/L) FINAL STAGE | (H/H) INITIAL STAGE | (H/H) FINAL STAGE | PEELING OF COATING AFTER TESTS | OTHER IMAGE QUALITY |
|---|---|---|---|---|---|---|---|---|---|---|---|
| EXAMPLE 3 | A | A | $D_{max}$ | 1.45 | 1.45 | 1.45 | 1.45 | 1.45 | 1.45 | ◎ | — |
| | | | GHOST | ◎ | ◎ | ○ | ○ | ◎ | ◎ | | |
| | | | FOG | ◎ | ◎ | ◎ | ◎ | ◎ | ◎ | | |
| EXAMPLE 4 | B | A | $D_{max}$ | 1.45 | 1.45 | 1.45 | 1.40 | 1.40 | 1.40 | ◎ | — |
| | | | GHOST | ○ | ○ | ○ | ○ | ○ | ○ | | |
| | | | FOG | ◎ | ◎ | ◎ | ○ | ◎ | ○ | | |
| EXAMPLE 5 | C | A | $D_{max}$ | 1.45 | 1.45 | 1.45 | 1.50 | 1.45 | 1.45 | ◎ | — |
| | | | GHOST | ◎ | ◎ | ◎ | ◎ | ○ | ◎ | | |
| | | | FOG | ◎ | ◎ | ○ | ○ | ◎ | ○ | | |
| EXAMPLE 6 | F | A | $D_{max}$ | 1.45 | 1.45 | 1.45 | 1.50 | 1.45 | 1.45 | ◎ | — |
| | | | GHOST | ◎ | ◎ | ◎ | ○ | ◎ | ◎ | | |
| | | | FOG | ◎ | ○ | ◎ | ◎ | ○ | ○ | | |
| COMPARISON EXAMPLE 3 | D | A | $D_{max}$ | 1.35 | 1.30 | 1.40 | 1.30 | 1.25 | 1.30 | Δ | — |
| | | | GHOST | Δ | X | Δ | X | ○ | Δ | | |
| | | | FOG | ○ | Δ | ○ | Δ | ○ | Δ | | |
| COMPARISON EXAMPLE 4 | E | A | $D_{max}$ | 1.45 | 1.20 | 1.45 | 1.10 | 1.40 | 1.25 | X | — |
| | | | GHOST | ○ | X | ○ | X | ○ | Δ | | |
| | | | FOG | ◎ | ◎ | ◎ | ○ | ◎ | ○ | | |
| COMPARISON EXAMPLE 5 | A | B | $D_{max}$ | 1.45 | 1.40 | — | — | — | — | ◎ | CONSPICUOUS SCATTERING AT IMAGE EDGES AFTER TESTS |
| | | | GHOST | ◎ | ○ | — | — | — | — | | |
| | | | FOG | ◎ | Δ | — | — | — | — | | |

What is claimed is

1. An image forming method, comprising:

(a) disposing an electrostatic image supporting member supporting an electrostatic image thereon and a toner carrying member for conveying a magnetic toner on the surface thereof in a development section with a predetermined gap between said members, wherein (i) said toner carrying member includes a base whose surface has irregularities with an average surface roughness (Ra) of 1.0 to 3.0 μm, and a resin coating on the surface of said base having a density of 4 to 12 g per 1 $m^2$, said resin coating containing electrically conductive fine particles and an outer layer of said resin coating having an Ra from 0.8 to 3.0 μm; and (ii) said magnetic toner is an electrically insulating magnetic toner containing at least a binder resin and a magnetic component, said magnetic toner satisfying the conditions of a volumetric average particle size of 4.5 to 8 μm, a BET specific surface area of 1.8 to 3.5 $m^2/g$, a charge amount of −20 to 31 35 μc/g, a loose-state apparent density of 0.40 to 0.52 $g/cm^3$, and a true specific gravity of 1.45 to 1.8;

(b) conveying said magnetic toner as a layer on said toner carrying member to said development section while regulating the thickness of the magnetic toner layer to a value smaller than the dimension of said gap by employing a toner layer thickness regulating member, wherein said toner layer thickness regulating member regulates the thickness of said layer of said magnetic toner by pressing said magnetic toner against said toner carrying member; and (c) developing said electrostatic image with said magnetic toner in said development section while applying an AC electric field.

2. The image forming method according to claim 1, wherein said magnetic toner is mixed with an inorganic fine powder.

3. The image forming method according to claim 1, wherein said magnetic toner is mixed with a hydrophobic silica fine powder.

4. The image forming method according to claim 1, wherein said magnetic toner is mixed with 0.6 to 1.6 parts by weight of a silica fine powder relative to 100 parts by weight of said magnetic toner.

5. The image forming method according to claim 1, wherein said magnetic toner is mixed with 0.6 to 1.6 parts by weight of a hydrophobic silica fine powder relative to 100 parts by weight of said magnetic toner.

6. The image forming method according to claim 1, wherein said toner layer thickness regulating member is an elastic blade, and wherein said resin coating on the surface of said base of said toner carrying member contains graphite.

7. The image forming method according to claim 6, wherein said resin coating contains electrically conductive carbon.

8. The image forming method according to claim 6, wherein said resin coating contains graphite and electrically conductive carbon.

9. The image forming method according to claim 8, wherein said resin coating contains graphite and electrically conductive carbon at a mixing ratio by weight of 1:50 to 100:1.

10. The image forming method according to claim 1, wherein said resin coating has a resistance of $10^{-2}$ to $10^{2}$ Ω·cm.

11. The image forming method according to claim 1, wherein said resin coating comprises a phenol resin.

12. The image forming method according to claim 1, including triboelectrically charging said magnetic toner by contact with the surface of said toner carrying member and the surface of said toner layer thickness regulating member, said triboelectrically charged magnetic toner developing an electrostatic image by reversal development in an AC electric field formed by an AC bias having a frequency of 200 to 4000 Hz and a peak-to-peak voltage of 500 to 3000 V.

13. The image forming method according to claim 12, wherein said triboelectrically charged magnetic toner develops an electrostatic image by reversal development in an AC electric field formed by an AC bias having a frequency of 500 to 2000 Hz and a peak-to-peak voltage of 800 to 2600 V.

14. The image forming method according to claim 1, including triboelectrically charging said magnetic toner by contact with the surface of said toner carrying member to provide a negative triboelectric charge thereon and developing by reversal development a negatively charged electrostatic image formed on an electrostatic image supporting member having an organic photoconductor layer with said negatively charged magnetic toner.

15. The image forming method according to claim 1, including the steps of (i) employing magnetic toner comprising 100 parts by weight of a binder resin, 20 to 200 parts by weight of a magnetic component, and a negative-charge control agent, (ii) providing a negative triboelectric charge on said magnetic toner by contact with a resin coating containing a phenol resin and a graphite and (iii) forming a magnetic toner layer whose thickness is regulated by an urethane rubber elastic blade.

16. An image forming apparatus, comprising:

(a) an electrostatic image supporting member supporting an electrostatic image thereon;

(b) a toner carrying member for conveying a magnetic toner on the surface thereof, said toner carrying member including a base whose surface has irregularities with an average surface roughness (Ra) of 1.0 to 3.0 μm, and a resin coating containing electrically conductive fine particles being formed on the surface of said base having a density of 4 to 12 g per 1 $m^2$ and an outer layer of said resin coating having an Ra within the range from 0.8 to 3.0 μm, said electrostatic image supporting member and said toner carrying member being disposed in a development section with a predetermined gap between said members;

(c) a container for accommodating said magnetic toner, said magnetic toner being an electrically insulating magnetic toner containing at least a binder resin and a magnetic component, said magnetic toner satisfying the conditions of a volumetric average particle size of 4.5 to 8 μm, a BET specific surface area of 1.8 to 3.5 $m^2/g$, a charge amount of −20 to −35 μc/g, a loose-state apparent density of 0.40 to 0.52 $g/cm^3$, and a true specific gravity of 1.45 to 1.8;

(d) a toner layer thickness regulating member for causing said magnetic toner to be conveyed on said toner carrying member while said magnetic toner forms a layer having a thickness of a dimension smaller than the dimension of said gap, said toner layer thickness regulating member regulating the thickness of said layer of said magnetic toner by pressing said magnetic toner against said toner carrying member; and (e) a bias application means for forming an AC electric field in said development section.

17. The image forming apparatus according to claim 16, wherein said magnetic toner is mixed with an inorganic fine powder.

18. The image forming apparatus according to claim 16, wherein said magnetic toner is mixed with a hydrophobic silica fine powder.

19. The image forming apparatus according to claim 16, wherein said magnetic toner is mixed with 0.6 to 1.6 parts by weight of a silica fine powder per 100 parts by weight of said magnetic toner.

20. The image forming apparatus according to claim 16, wherein said magnetic toner is mixed with 0.6 to 1.6 parts by weight of a hydrophobic silica fine powder per 100 parts by weight of said magnetic toner.

21. The image forming apparatus according to claim 16, wherein said toner layer thickness regulating member is an elastic blade, and wherein said resin coating on the surface of said base of said toner carrying member contains graphite.

22. The image forming apparatus according to claim 21, wherein said resin coating contains electrically conductive carbon.

23. The image forming apparatus according to claim 21, wherein said resin coating contains graphite and electrically conductive carbon.

24. The image forming apparatus according to claim 23, wherein said resin coating contains graphite and electrically conductive carbon at a mixing ratio by weight of 1:50 to 100:1.

25. The image forming apparatus according to claim 16, wherein said resin coating has a resistance of $10^{-2}$ to $10^{2}$ Ω·cm.

26. The image forming apparatus according to claim 16, wherein said resin coating comprises a phenol resin.

27. The image forming apparatus according to claim 16, wherein said bias application means causes an AC electric field to be formed by an AC bias having a frequency of 200 to 4000 Hz and a peak-to-peak voltage of 500 to 3000 V.

28. The image forming apparatus according to claim 16, wherein said bias application means causes an AC electric field to be formed by an AC bias having a frequency of 500 to 2000 Hz and a peak-to-peak voltage of 800 to 2600 V.

29. The image forming apparatus according to claim 16, wherein said electrostatic image supporting member has an organic photoconductor layer for forming a negatively charged electrostatic image.

30. The image forming apparatus according to claim 16, wherein said toner layer thickness regulating member comprises an urethane rubber elastic blade or an acrylonitrile-butadiene rubber elastic blade.

* * * * *

UNITED STATES PATENT AND TRADEMARK OFFICE

CERTIFICATE OF CORRECTION

PATENT NO. : 5,215,845

DATED : June 1, 1993

INVENTOR(S) : HIROSHI YUSA, ET AL.

It is certified that error appears in the above-identified patent and that said Letters Patent is hereby corrected as shown below:

COLUMN 15

Line 6, "silicate" (first occurrence) should read --silicate,--.

COLUMN 16

Line 7, "3'30" should read --30--.

COLUMN 18

Line 35, "-27 82" should read -- -27 μ--.

COLUMN 22

Line 63, "31 35 μc/g," should read -- -35 μc/g,--.

Signed and Sealed this

Twenty-second Day of March, 1994

Bruce Lehman

*Attest:*

BRUCE LEHMAN

*Attesting Officer*

*Commissioner of Patents and Trademarks*

--